US005199715A

United States Patent [19]

May

[11] Patent Number: 5,199,715

[45] Date of Patent: Apr. 6, 1993

[54] GAME DEVICE FOR CATCHING A BALL ON A TARGET

[76] Inventor: Richard A. May, 1800 Sunrise Way, Palm Springs, Calif. 92264

[21] Appl. No.: 856,344

[22] Filed: Mar. 23, 1992

[51] Int. Cl.[5] ..... A63B 67/10

[52] U.S. Cl. ..... 273/331; 273/346; 273/412; 273/414; 273/DIG. 19; 273/DIG. 30

[58] Field of Search ..... 273/331, 335, 346, 412, 273/414, DIG. 19, DIG. 30

[56] References Cited

U.S. PATENT DOCUMENTS

| | | | |
|---|---|---|---|
| 3,032,345 | 5/1962 | Lemelson | 273/346 |
| 3,104,877 | 9/1963 | Gross | 273/414 |
| 3,110,497 | 11/1963 | Broman et al. | 273/414 |
| 3,471,154 | 10/1969 | Saunders | 273/DIG. 19 X |
| 3,610,622 | 10/1971 | Haroski | 273/412 |
| 3,999,748 | 12/1976 | Clarke | 273/346 |
| 4,274,639 | 6/1981 | Flanders | 273/414 X |

*Primary Examiner*—William H. Grieb
*Attorney, Agent, or Firm*—Frederick Gotha

[57] ABSTRACT

A game and sport apparatus is set forth which is played by two players for placing a ball on a target. Each player carries a frame which is belted to the player's waist. The frames are connected by an elastic cord from which a body covered with a hook and loop fabric is suspended by a flexible string. A target surface consisting of a hook and loop fabric is provided on each frame and to play the game, each player by various body movements causes the body to move about the elastic cord and attempts to catch the body on the target surface.

10 Claims, 3 Drawing Sheets

GAME DEVICE FOR CATCHING A BALL ON A TARGET

FIELD OF THE INVENTION

This invention relates to a game and sport activity where the players at all times are connected to each other by an elastic cord from which a ball is suspended such that by various bodily movements the player attempts to manipulate the ball onto a target surface.

BACKGROUND OF THE INVENTION

With the introduction of hook and loop fabric, conventionally known as "Velcro" (a registered trademark of the Velcro Manufacturing Company), a variety of articles for sport and play requiring the adherence of a body to the surface of a play article have been developed. For example, U.S. Pat. No. 3,032,345 is directed to a dart game in which the tip surface of the dart and the front surface of the target were covered with a "Velcro" material. When the dart is thrown at the target, the dart adheres to the target thereby simulating an actual game of darts. Another example of a Velcro material sport and play apparatus was disclosed in U.S. Pat. No. 3,999,748 which related to a ball covered with a Velcro material and a mitt or glove which had an outer face that was also covered with a Velcro material. Thus, a game of catch, particularly for young children, was created which not only allowed the child to be successful in throwing and catching a ball but also contributed to the development of the hand-eye coordination of the child. A Velcro material covering a ball and mitt was also utilized in U.S. Pat. No. 4,995,617 which permitted young children and even adults, to catch a hard thrown ball without injury to the hand or bouncing from the mitt.

The sport and game activities involving the act of throwing an object covered with a Velcro material toward a receptor such as a board or a mitt covered with a Velcro material is a singular activity performed independently by one of the participants. The act of catching the ball is also a singular activity performed by the other participant. Similarly, the throwing of a dart toward a target is a singular act performed by the participant and the flight of the dart is not influenced by the movement of another competitor who is playing the game. The participants are not simultaneously engaging in physical activity where each has an immediate simultaneous effect upon the special location of the ball or dart by body movement.

SUMMARY OF THE INVENTION

There is, therefore, provided according to the present invention, a game device played simultaneously by two players for placing a ball on a target carried respectively by each player.

The present invention is directed to a game apparatus which consists of a pair of frames having a target support surface covered in part by a hook and loop fabric forming the target. The respective frames are belted to each participant anteriorally at the waist of each player and connected by an elastic cord extending between each of the frames. A ball which has an outer surface covering of a hook and loop fabric is connected to the elastic cord by a flexible string at the approximate midpoint of the elastic cord. To play the game, each player by gyrational body movements causes the ball on the flexible string to move in a three dimensional direction within an envelope prescribed by the extension of the flexible string. By the player using his body to pull or push against the elastic cord while at the same time gyrating, the ball on the flexible string will dart about in the space between the two players; while the ball is darting about within the envelope of the flexible string, a player attempts to catch the ball on a hook and loop fabric target contained on a target support surface carried by the frame. In the preferred embodiment of the invention, the body suspended on the flexible string is a ball member covered with a hook and loop fabric conventionally known as "Velcro" (a registered trademark of the Velcro Manufacturing Company), and a target of concentric circular rings made of Velcro material and contained on a netting which forms the target support surface carried by the frame. Thus, if the ball can be positioned by a player to strike one of the concentric circles forming the target, the ball will adhere to the hook and fabric of the material of the target earning the player a predetermined score for successfully maneuvering the ball to the target. A participant in the game is thereby challenged to maneuver the ball while his opponent is simultaneously attempting to also maneuver the ball either into his target or preventing the ball from adhering to the target carried by his opponent. Participating in the game requires physical stamina and the exercise of many body muscles during the numerous body gyrations and body movements required to position the target. Capturing the ball is a rigorous exercise that conditions the body while at the same time enables the participant to find competitive enjoyment in the playing of the game.

BRIEF DESCRIPTION OF THE DRAWINGS

These and other features and advantages will become appreciated as the same become better understood with reference to the following specification, claims and drawings wherein:

DETAILED DESCRIPTION

Figure 1:
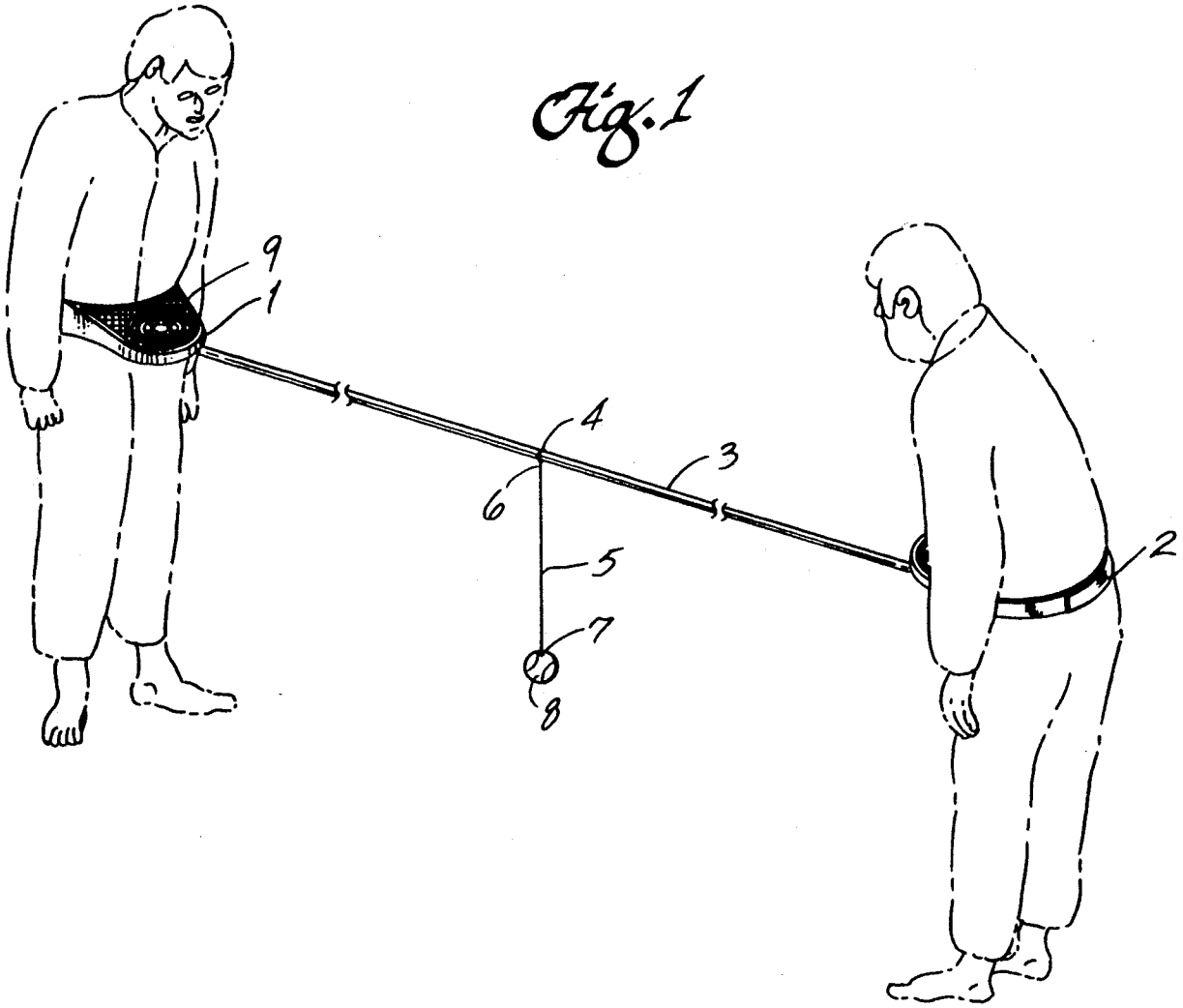
FIG. 1 is a perspective view of the game apparatus attached to the respective participants.

Referring to FIG. a perspective view is shown of two participants about to engage in the game and sport of this invention. As can be seen in FIG. 1, each player carries a frame 1 which is strapped to his waist by a belt means 2. An elastic cord 3 is securely fastened to the respective frames carried by the participants and interconnects the players to permit an elastic expansion or retraction of the cord 3 by an appropriate body gyration. At the approximate mid point of the cord 4 a flexible string 5 is carried or connected at a first end 6 to the cord and at its second end 7 to body 8. The method of connecting a flexible string to a body so that the body would be retained on the string while the body is in motion or at rest is well known in the art and would be a matter of choice for one skilled in this art. In one embodiment of the invention, body 8 is a ball whose surface is covered with a hook and loop fabric conventionally known as "Velcro" (a registered trademark of the Velcro Manufacturing Company). In another embodiment, the body 8, although not shown in the drawings, could be a cube or any other geometrical shape suspended from the flexible string 5 and in part or substantially covered with a hook and loop fabric.

In playing the game of this invention, the participants by pulling, pushing, and through body gyrations cause the body 8 to move in various directions about the mid point 4 of the cord 3. By engaging in such body activity, the participant attempts either to catch the ball on target surface 9 carried by that participant or to prevent his opponent from catching the body 8 on the target surface carried by his opponent.

Figure 2:
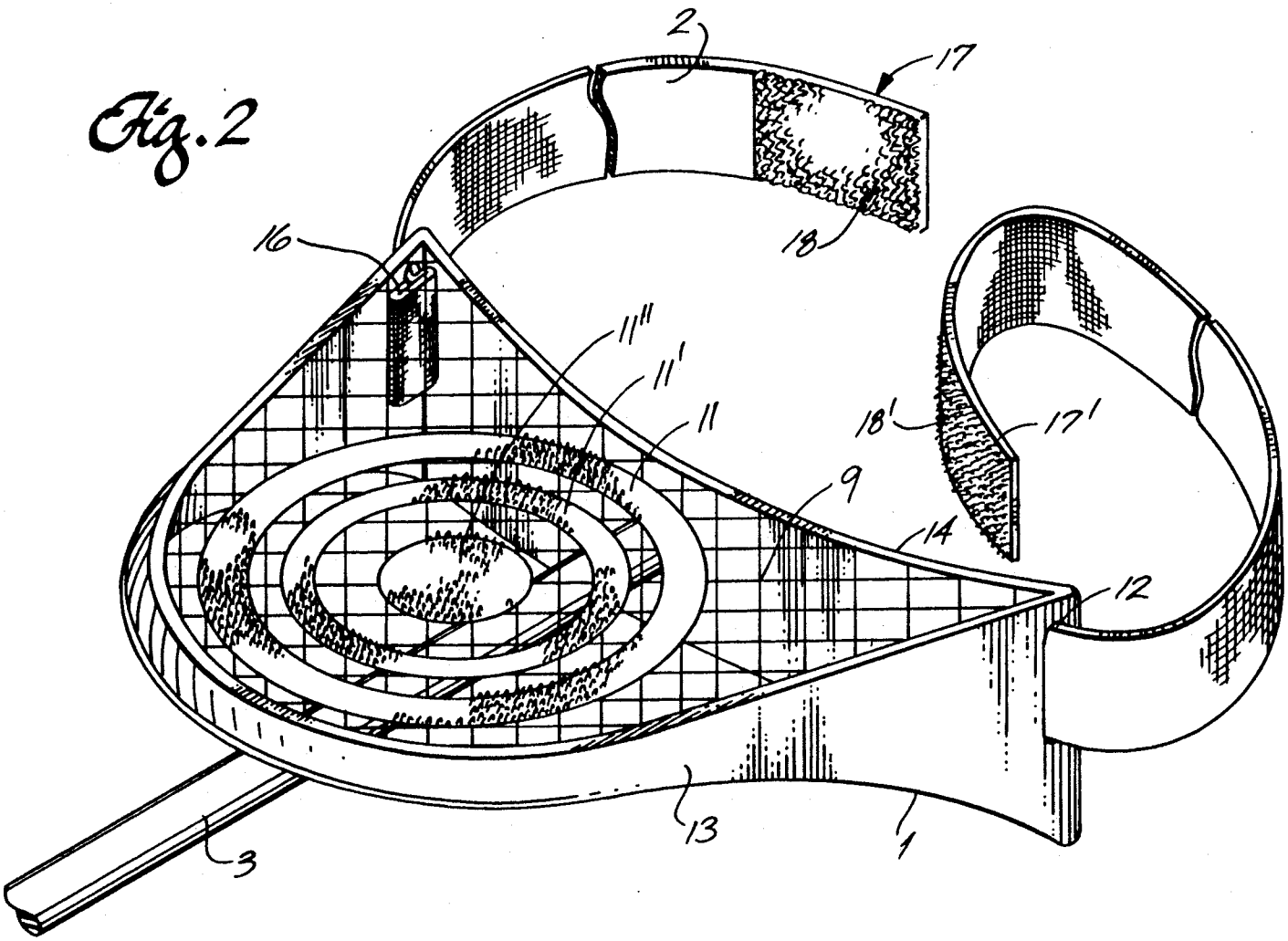
FIG. 2 is a perspective view of the frame of this invention.

In FIG. 2, a perspective view of the frame 1 is shown in the preferred embodiment of this invention. As can be seen in FIG. 2, the target surface 9 is a net-type surface which may be stitched to the frame or mounted to the frame in much the same manner as the strings of a tennis racket are strung within the tennis racket frame, or bonded. Target indicia 11, 11' and 11" are securely carried by the target surface and in the preferred embodiment consist of concentric circular rings made of "Velcro" and having a central "bull's eye" circle 11" which is also covered with a hook and loop type fabric such as "Velcro". In the preferred embodiment of the invention, the frame 1 is made of a molded plastic material and the belt means 2 is made of "nylon". The belt means 2 is attached to the frame 1 by inserting one end of the belt means through an opening 12 located near the intersection of the anterior section 13 and the body bearing section 14 of the frame 1. As can be seen in FIG. 2, to secure the belt to the frame, the belt is looped at its frame attachment end such that the loop cannot pass through opening 12. At the free ends 17 and 17' of belt means 2, a sufficient area 18 and 18' is covered with a hook and loop fabric material such a "Velcro" to permit the participant to securely fasten the frame to his waist.

Figure 3:
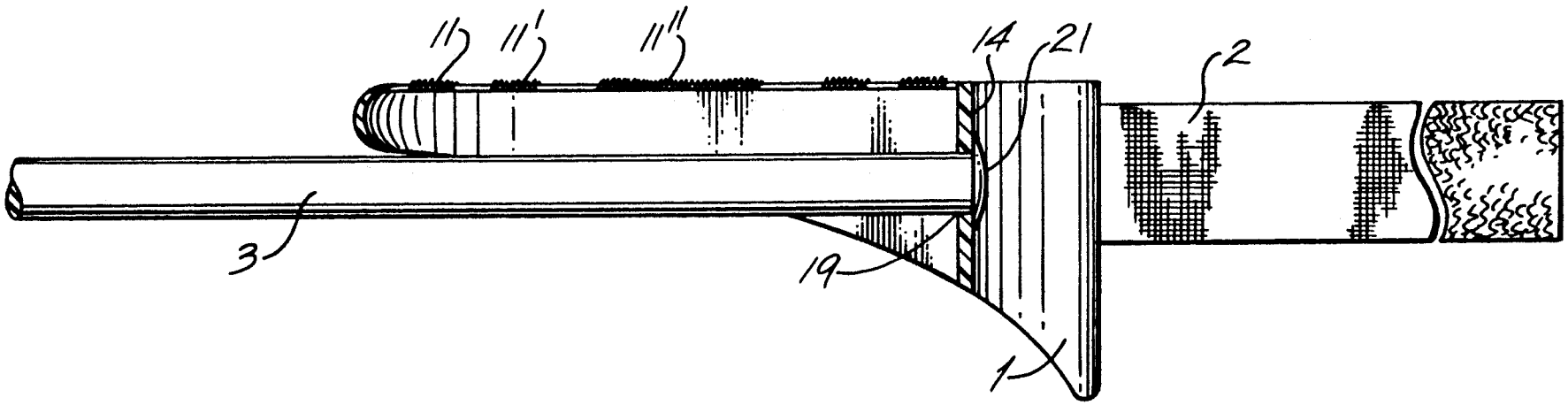
FIG. 3 is a side partial cross-sectional view of the frame shown in FIG. 2.

In FIG. 3, a partial cross-sectional side elevational view is shown of FIG. 2. As can be seen in FIG. 3, the elastic cord 3 passes through an orifice 19 contained in the body bearing surface 14 of frame 1. A cap 21 is fixedly attached to body bearing section 14 and provides for a rigid attachment of elastic cord 3 to the respective frames.

In another embodiment of this invention, the target surface 9 may be a solid surface partially or wholly covered by target indicia made of a hook and loop-type "Velcro" material for catching a body whose surface maybe covered in whole or in part with a separately adherent hook and loop-type fabric.

Thus, to play the game the participants by body movement cause the body 8 to swing in various directions about elastic cord 3 and within the envelope permitted by flexible string 5. Simultaneously the participants are attempting to position the target surface 9 with target indicia 11, 11' and 11" so as to catch the body 8 when the hook and loop material of the target indicia and of the body 8 come into contact.

While I have shown and described certain embodiments of the present game device for placing a ball on target indicia, it is to be understood that it is subject to many modifications without departing from the spirit and scope of the claims as recited herein.

What is claimed is:

1. A game apparatus played by a pair of players for catching a body on a target comprising:

(a) a pair of frames each having a target surface where said target surface carries and is covered at least in part by a hook and loop fabric;

(b) an elastic cord interconnecting said frames;

(c) a flexible string having a first end carried by said elastic cord and a second end connected to said body where said body has a surface substantially covered by a hook and loop fabric such that said body is separably adherent to said hook and loop fabric carried by said target surface; and (d) belt means carried by each said frame for attaching said frame to said player whereby each player by his movements influences the motion and location of said body for catching said body on the respective target surface carried by said player.

2. The game apparatus recited in claim 1 wherein said hook and loop fabric carried by said target surface define target indicia.

3. The game apparatus recited in claim 2 wherein said target indicia comprise a plurality of concentric circular rings.

4. The game apparatus recited in claim 3 wherein said target surface comprises a net.

5. The game apparatus recited in claim 4 where said target indicia are bonded to said net.

6. In a game apparatus for catching a body having a surface substantially covered by a hook and loop fabric where said body may be separably adherent to a hook and loop type fabric in combination comprising, a first frame having a target surface where said target surface carries and is covered in part by a hook and loop fabric, a second frame having a target surface where said target surface carries and is covered in part by a hook and loop fabric, an elastic cord interconnecting said first and second frames, a flexible string having a first end carried by said elastic cord and a second end connected to said body, first belt means carried by said first frame for attaching said first frame to a game participant, and second belt means carried by said second frame for attaching said second frame to another game participant whereby each of said participants by his movements influences the motion and location of said body and thereby attempts to catch said body on the respective target surface carried by said participant.

7. The combination recited in claim 6 wherein said hook and loop fabric carried by said target surface define target indicia.

8. The combination recited in claim 7 where said target indicia comprise a plurality of concentric circular rings.

9. The combination recited in claim 8 wherein said target surface comprises a net.

10. The combination recited in claim 9 where said target indicia are bonded to said net.

* * * * *